US012084815B2

(12) United States Patent
Ding et al.

(10) Patent No.: US 12,084,815 B2
(45) Date of Patent: Sep. 10, 2024

(54) SWITCH FOR TRACK OF MAGLEV TRAIN

(71) Applicant: CRRC QINGDAO SIFANG CO., LTD., Shandong (CN)

(72) Inventors: Sansan Ding, Shandong (CN); Yi Tian, Shandong (CN); Heming Yuan, Shandong (CN); Xiangdong Sun, Shandong (CN)

(73) Assignee: CRRC QINGDAO SIFANG CO., LTD., Shandong (CN)

( * ) Notice: Subject to any disclaimer, the term of this patent is extended or adjusted under 35 U.S.C. 154(b) by 899 days.

(21) Appl. No.: 17/263,565

(22) PCT Filed: Sep. 20, 2019

(86) PCT No.: PCT/CN2019/106870

§ 371 (c)(1),
(2) Date: Jan. 27, 2021

(87) PCT Pub. No.: WO2020/151243

PCT Pub. Date: Jul. 30, 2020

(65) Prior Publication Data

US 2021/0172123 A1 Jun. 10, 2021

(30) Foreign Application Priority Data

Jan. 23, 2019 (CN) ..... 201910063627.4
Jan. 23, 2019 (CN) ..... 201920113875.0

(51) Int. Cl.
*E01B 25/12* (2006.01)
*E01B 25/34* (2006.01)

(52) U.S. Cl.
CPC ..... *E01B 25/34* (2013.01); *E01B 25/12* (2013.01); *E01B 2202/025* (2013.01); *E01B 2202/027* (2013.01); *E01B 2202/048* (2013.01)

(58) Field of Classification Search
CPC .... E01B 25/12; E01B 25/34; E01B 2202/025; E01B 2202/027; E01B 25/00;
(Continued)

(56) References Cited

U.S. PATENT DOCUMENTS 2,903,972 A * 9/1959 Schutze ..... E01B 25/12 104/103
2,997,004 A * 8/1961 Roseubaum ..... E01B 25/12 104/103

(Continued)

FOREIGN PATENT DOCUMENTS

| | | | |
|---|---|---|---|
| CN | 2687161 | Y | 3/2005 |
| CN | 2687162 | Y | 3/2005 |
| CN | 2700383 | Y | 5/2005 |
| CN | 1648342 | A | 8/2005 |
| CN | 101255673 | A | 9/2008 |
| CN | 101392480 | A | 3/2009 |

(Continued)

OTHER PUBLICATIONS

The Chinese 1st Office Action issued on Oct. 24, 2023 for CN201910063627.4.

(Continued)

*Primary Examiner* — Zachary L Kuhfuss
(74) *Attorney, Agent, or Firm* — Yue (Robert) Xu; Apex Attorneys at Law, LLP

(57) ABSTRACT

A switch for a track of a maglev train is provided. The switch comprises a front main track beam and a rear switching track beam. The rear switching track beam comprises a central fixed track beam and a middle mobile track beam; the front main track beam can switch between a straight track and a bent track by bending; the central fixed track beam is a fixed track beam; and the middle mobile track beam can move parallelly between the straight track and the bent track. The imposed deformation length and driving weight of the switch is minimised by providing the middle mobile track beam, and the required track switching time is shortened.

14 Claims, 4 Drawing Sheets

(58) Field of Classification Search
CPC ..... E01B 2202/048; E01B 7/00; E01B 7/14; E01B 25/08
USPC ..... 140/130.11
See application file for complete search history.

(56) References Cited

U.S. PATENT DOCUMENTS

| | | | | |
|---|---|---|---|---|
| 3,093,090 | A * | 6/1963 | Rosenbaum | E01B 25/12 104/118 |
| 3,847,086 | A | 11/1974 | Steenbeck | |
| 5,287,811 | A | 2/1994 | Matsuura et al. | |
| 7,588,215 | B2 * | 9/2009 | Bogl | E01B 25/34 246/434 |
| 8,714,092 | B2 * | 5/2014 | Heitzenrater | E01B 7/00 104/130.09 |
| 2003/0154878 | A1 * | 8/2003 | Fichtner | E01B 25/34 104/130.11 |
| 2005/0172850 | A1 * | 8/2005 | Sakita | E01B 25/12 104/130.01 |
| 2009/0013898 | A1 * | 1/2009 | Zheng | E01B 25/34 104/130.01 |
| 2009/0114775 | A1 | 5/2009 | Wunder | |
| 2010/0269728 | A1 * | 10/2010 | Fichtner | E01B 25/34 104/130.02 |

FOREIGN PATENT DOCUMENTS

| | | | |
|---|---|---|---|
| CN | 101449003 | A | 6/2009 |
| CN | 107858878 | A | 3/2018 |
| CN | 208021482 | U | 10/2018 |
| CN | 208183445 | U | 12/2018 |
| CN | 109629351 | A | 4/2019 |
| DE | 10148165 | A1 | 10/2002 |
| JP | S5383211 | A | 7/1978 |
| JP | S57133902 | A | 8/1982 |
| JP | S596763 | A | 1/1984 |
| JP | S59122601 | A | 7/1984 |
| JP | S62194301 | A | 8/1987 |
| JP | H0245255 | A | 2/1990 |
| JP | H04161502 | A | 6/1992 |
| JP | H05280003 | A | 10/1993 |
| JP | 2004346674 | A | 12/2004 |
| JP | 2005036440 | A | 2/2005 |

OTHER PUBLICATIONS

The Japanese 1st Office Action issued on Nov. 22, 2021 for JP2021-506037.
International Search Report for PCT/CN2019/106870 mailed Dec. 16, 2019, ISA/CN.

* cited by examiner

SWITCH FOR TRACK OF MAGLEV TRAIN

The present application is a National Phase entry of PCT Application No. PCT/CN2019/106870, filed on Sep. 20, 2019, which claims priorities to the following patent applications, and the entire disclosures of which are incorporated herein by reference, 1) Chinese patent application No. 201910063627.4, filed with the China National Intellectual Property Administration on Jan. 23, 2019, titled "SWITCH FOR TRACK OF MAGLEV TRAIN"; and
2) Chinese utility model patent application No. 201920113875.0, filed with the China National Intellectual Property Administration on Jan. 23, 2019, titled "SWITCH FOR TRACK OF MAGLEV TRAIN".

FIELD

The present application relates to the technical field of maglev trains, and in particular to a switch for a track of a maglev train.

BACKGROUND

A maglev train has been attracting attention because it almost has no friction resistance. The maglev train maintains suspension, travels forward and makes a turn depending on electromagnets on two sides of the track, thus, the train body needs to envelop the lower on two side of the track. When the train needs to change the direction of the track, the function of the switch is particularly important.

At present, a common switch for the track of the maglev train has the mechanical structure of forced elastic deformation, which has a large driving mass and a long track switching time.

Therefore, an important technical problem to be solved by those skilled in the art is how to minimize the forced elastic length of the switch and reduce the driving mass and the track switching time.

SUMMARY

In order to solve the technical problem, a switch for a track of a maglev train is provided according to the present application, which includes a front main track beam and a rear switching track beam, and the rear switching track beam includes a central fixed track beam and a middle movable track beam;

the front main track beam can switch between a straight track and a bend track by bending, and the central fixed track beam is a fixed track beam, and the middle movable track beam can move parallelly between the straight track and the bend track;

if the maglev train passes through the switch along the bend track, the front main track beam bends to the bend track, and the middle movable track beam parallelly moves to the bend track;

if the maglev train passes through the switch along the straight track, the front main track beam needs to be restored to the straight track, and the middle movable track beam parallelly moves to the straight track.

A switch for a track of a maglev train is provided according to another solution of the present application, which includes a front main track beam and a rear switching track beam, and the rear switching track beam includes a central fixed track beam and a middle movable track beam;

the front main track beam can rotate between a straight track and a bend track, and the central fixed track beam is a fixed track beam, and the middle movable track beam can move parallelly between the straight track and the bend track;

if the maglev train passes along the bend track, the front main track beam rotates around a rotation axis to the bend track, and the middle movable track beam parallelly moves to the bend track;

if the maglev train passes along the straight track, the front main track beam rotates around the rotation axis to the straight track, and the middle movable track beam parallelly moves to the straight track.

Optionally, the central fixed track beam includes a first outer side beam for connecting the front main track beam with the bend track and a second outer side beam for connecting the front main track beam with the straight track.

The first outer side beam and the second outer side beam are fixed track beams.

Optionally, the central mobile track beam is approximately a U-shaped similar track beam.

Optionally, the central mobile track beam includes a lateral beam and a first inner side beam and a second inner side beam that are respectively provided on two ends of the lateral beam.

Optionally, a roller is provided on the bottom of the lateral beam, so that the middle movable track beam can move between the first outer side beam and the second outer side beam of the central fixed track beam.

Optionally, the switch for the track of the maglev train further includes a bearing track provided at the bottom of the lateral beam and matched with the roller.

Optionally, the front main track beam is a cement or steel beam.

Optionally, the central fixed track beam is a fixed cement or steel beam.

Optionally, the middle movable track beam is the cement or steel beam.

Compared with the above background technology, the switch for the track of the maglev train provided according to the present application has the following beneficial effects that the switch minimizes the forced deformation length by providing the middle movable track beam, the driving mass is minor, and the required track switching time is shortened.

BRIEF DESCRIPTION OF THE DRAWINGS

To illustrate technical solutions according to the embodiments of the present application or in the conventional technology more clearly, the drawings to be used in the description of the conventional technology or the embodiments are described briefly hereinafter. Apparently, the drawings described hereinafter are only some embodiments of the present application, and other drawings may be obtained by those skilled in the art based on those drawings without any creative effort.

Figure 1:
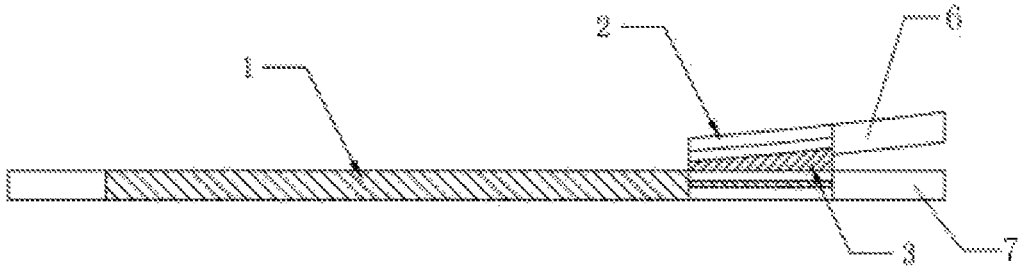
FIG. 1 is a schematic structural view of a switch for a track of a maglev train according to a specific embodiment of the present application in a straight track state.

Reference numerals:

| | | | |
|---|---|---|---|
| 1 | front main track beam, | 2 | central fixed track beam, |
| 21 | first outer side beam, | 22 | second outer side beam, |
| 3 | middle movable track beam, | 31 | first inner side beam, |
| 32 | second inner side beam, | 33 | lateral beam, |
| 34 | roller, | 4 | bearing track, |
| 5 | maglev train, | 6 | bend track, |
| 7 | straight track. | | |

DETAILED DESCRIPTION OF THE EMBODIMENTS

The embodiments of the present application are described in detail hereinafter, and examples of the embodiments are shows in drawings, in which the same or similar reference numerals represent the same or similar members or members having the same or similar functions throughout the description. The embodiments described below with reference to the drawings are only exemplary embodiments which are used to explain the present application, and should not be construed to limit the present application.

In the description of the present application, it is to be understood that the orientation or positional relationships indicated by terms "center", "longitudinal", "lateral", "length", "width", "thickness", "up", "down", "front", "rear", "left", "right", "vertical", "horizontal", "top", "bottom", "inner", "outer", "clockwise", "anticlockwise" and the like are based on the orientation or positional relationships shown in the drawings, and are merely for the convenience of describing the present application and the simplification of the description, and do not indicate or imply that the device or member referred to must be in a particular orientation, or be constructed and operated in a particular orientation, and therefore should not be construed as a limitation to the scope of the present application.

In addition, the terms "first", "second" and the like are for purpose of description, and should not be interpreted as indicating or implying relative importance or implying the number of the indicated technical features. Thus, the features defined by "first", "second" and the like can express or impliedly include one or more the features. In the description of the present application, the meaning of "multiple or a plurality of" is two or more, unless otherwise specifically defined.

In the description of the present application, it should be pointed out that, terms "install", "link", "connect" and "fix" should be understood broadly, unless otherwise specifically defined. For example, it can be fixedly connected or detachably connected or integrally connected; it can be mechanically connected or electrically connected; it can be directly connected or indirectly connected through intermediate media, or inner parts of two components are in communication with each other. For those skilled in the art, the specific meaning of the above terms in the present application may be understood in the light of specific circumstances.

A core of the present application is to provide a switch for a track of a maglev train. The switch can minimize the switch movement and the forced deformation length, and the driving mass thereof is minor, and the required track switching time is shortened.

In order to make the person skilled in the art have a better understanding of solutions of the present application, the present application is described in further detail hereinafter, in conjunction with the drawings and embodiments.

Figure 2:
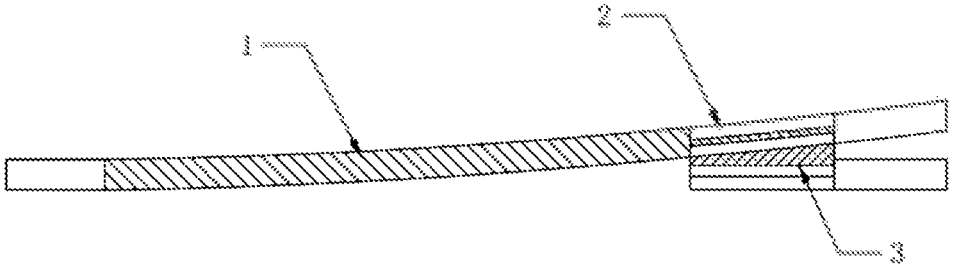
FIG. 2 is a schematic structural view of the switch for the track of the maglev train according to a specific embodiment of the present application in a bend track state.
Figure 3:
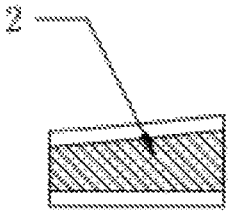
FIG. 3 is a schematic structural view of a central fixed track beam according to a specific embodiment of the present application.
Figure 4:
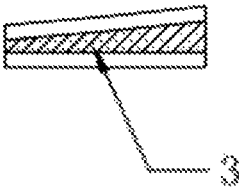
FIG. 4 is a schematic structural view of a middle movable track beam according to a specific embodiment of the present application.
Figure 5:
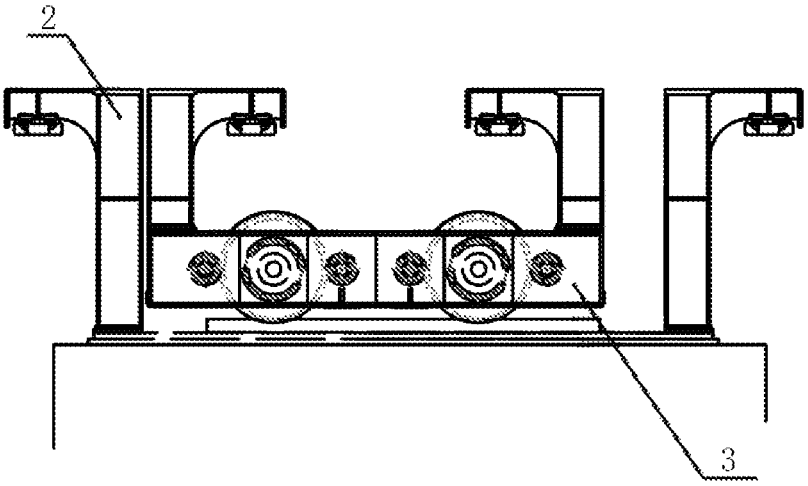
FIG. 5 is a side view (located at a bend track position) of a rear switching track beam according to a specific embodiment of the present application.
Figure 6:
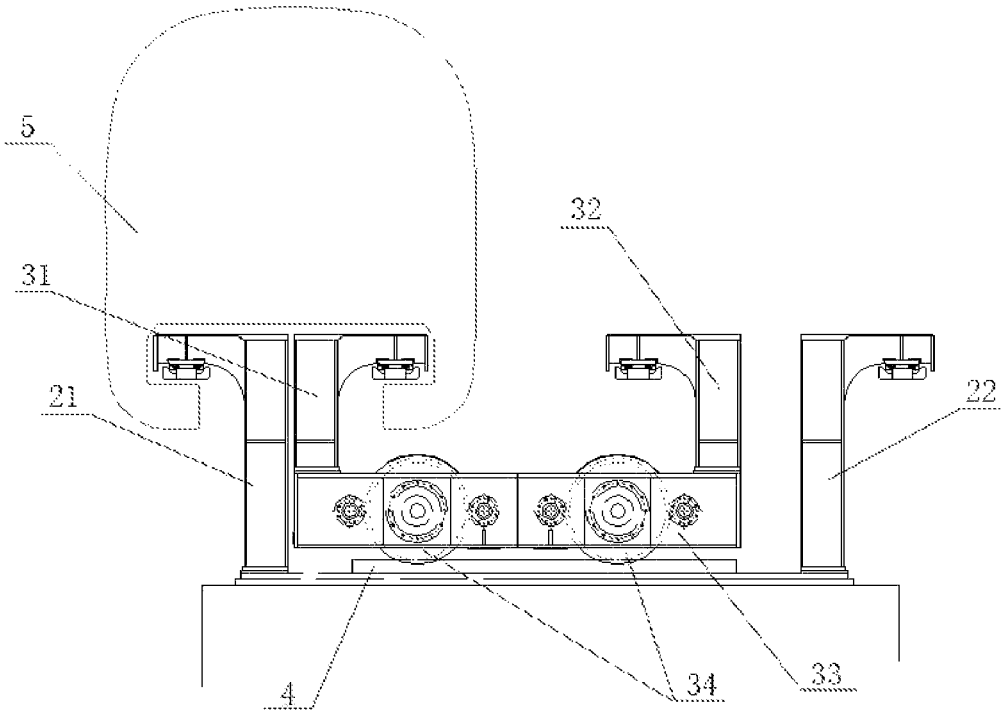
FIG. 6 is a side view (located at a bend track position and the maglev train is shown) of the rear switching track beam according to a specific embodiment of the present application.
Figure 7:
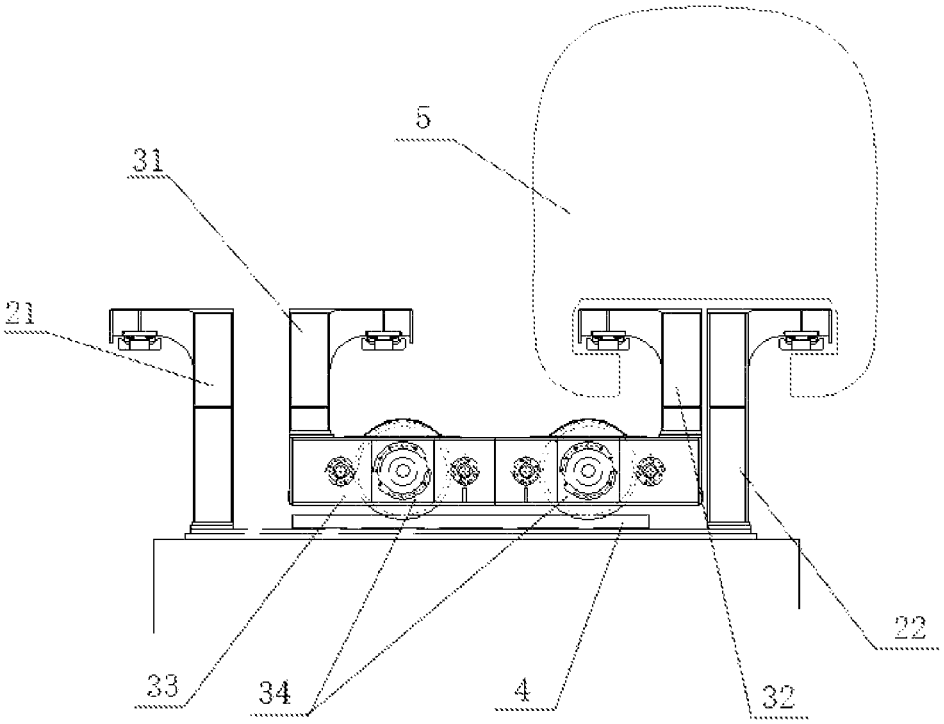
FIG. 7 is a side view (located at a straight track position and the maglev train is shown) of the rear switching track beam according to a specific embodiment of the present application.

Referring to FIGS. 1 to 7, FIG. 1 is a schematic structural view of a switch for a track of a maglev train according to a specific embodiment of the present application in a straight track state; FIG. 2 is a schematic structural view of the switch for the track of the maglev train according to a specific embodiment of the present application in a bend track state; FIG. 3 is a schematic structural view of a central fixed track beam according to a specific embodiment of the present application; FIG. 4 is a schematic structural view of a middle movable track beam according to a specific embodiment of the present application; FIG. 5 is a side view (located at a bend track 6 position) of a rear switching track beam according to a specific embodiment of the present application; FIG. 6 is a side view (located at a bend track 6 position and a maglev train 5 is shown) of the rear switching track beam according to a specific embodiment of the present application; and FIG. 7 is a side view (located at a straight track 7 position and the maglev train 5 is shown) of the rear switching track beam according to a specific embodiment of the present application.

In a specific embodiment, the switch for the track of the maglev train is provided according to the present application, as shown in FIGS. 1 to 4. The switch includes a front main track beam 1 and a rear switching track beam. The rear switching track beam includes a central fixed track beam 2 and a middle movable track beam 3. The front main track beam 1 can rotate or switch between a straight track 7 and a bend track 6 by bending, the central fixed track beam 2 is a fixed track beam, and the middle movable track beam 3 may move parallelly between the straight track 7 and the bend track 6.

In a specific embodiment, the switch for the track of the maglev train is provided according to the present application, as shown in FIGS. 5 to 7. The central fixed track beam 2 includes a first outer side beam 21 for connecting the front main track beam 1 with the bend track 6 and a second outer side beam 22 for connecting the front main track beam 1 with the straight track 7. The first outer side beam 21 and the second outer side beam 22 are fixed track beams.

In a specific embodiment, the switch for the track of the maglev train is provided according to the present application, the middle movable track beam 3 is approximately a U-shaped track beam. The central mobile track beam 3 includes a lateral beam 33 and a first inner side beam 31 and a second inner side beam 32 that are respectively provided on two ends of the lateral beam. A roller 34 is provided at the bottom of the lateral beam 33, so that the middle movable track beam 3 may move between the first outer side beam 21 and the second outer side beam 22 of the central fixed track beam 2.

In a specific embodiment, the switch for the track of the maglev train is provided according to the present application, as shown in FIG. 6. When the middle movable track beam 3 moves to a position close to the first outer side beam 21, the first outer side beam 21 and the first inner side beam 31 are combined to form a transition beam for the maglev train 5 to pass through the bend track 6. As shown in FIG. 7, when the middle movable track beam 3 moves to a position close to the second outer side beam 22, the second outer side beam 22 and the second inner side beam 32 are combined to form a transition beam for the maglev train 5 to pass through the straight track 7.

In a specific embodiment, the switch for the track of the maglev train provided according to the present application further includes a bearing track 4 provided at the bottom of the lateral beam 33 and configured to cooperate with the roller 34. The roller 34 moves on the bearing track 4, so as to achieve the switching of the middle movable track beam 3 between the bend track 6 and the straight track 7.

In a specific embodiment, the switch for the track of the maglev train is provided according to the present application, the front main track beam 1 and the middle movable track beam 3 are cements or steel beams. The central fixed track beam 2 is a fixed cement or steel beam.

In a specific embodiment, the switch for the track of the maglev train is provided according to the present application, as shown in FIGS. 5 and 6, when the maglev train 5 travels on the bend track 6, the front main track beam 1 rotates around a rotation axis or bends to the bend track 6, and the middle movable track beam 3 parallelly moves to a position close to the first outer side beam 21. As shown in FIG. 7, when the maglev train 5 passes along the straight track 7, the front main track beam 1 rotates around the rotation axis or bends to the straight track 7, and the middle movable track beam 3 parallelly moves to a position close to the second outer side beam 22. The switch minimizes the forced elastic length, reduces driving mass and the track switching time.

The switch for the track of the maglev train according to the present application is described in detail hereinbefore. The principle and the embodiments of the present application are illustrated herein by specific examples. The above description of examples is only intended to help the understanding of the method and spirit of the present application. It should be noted that, for those skilled in the art, many modifications and improvements may be made to the present application without departing from the principle of the present application, and these modifications and improvements are also deemed to fall into the protection scope of the present application defined by the claims.

What is claimed is:

1. A switch for a track of a maglev train, comprising:

a front main track beam; and a rear switching track beam, wherein, the rear switching track beam comprises a central fixed track beam and a middle movable track beam; wherein, the front main track beam is configured to switch between a straight track and a bend track by bending, the central fixed track beam is a fixed track beam, and the middle movable track beam is configured to move parallelly between the straight track and the bend track;

if the maglev train passes through the switch along the bend track, the front main track beam bends to the bend track, and the middle movable track beam parallelly moves to the bend track;

if the maglev train passes through the switch along the straight track, the front main track beam needs to be returned to the straight track, and the middle movable track beam parallelly moves to the straight track, wherein, the middle movable track beam is a U-shaped track beam.

2. The switch for the track of the maglev train according to claim 1, wherein, the central fixed track beam comprises a first outer side beam for connecting the front main track beam with the bend track and a second outer side beam for connecting the front main track beam with the straight track; wherein, the first outer side beam and the second outer side beam are fixed track beams.

3. The switch for the track of the maglev train according to claim 1, wherein, the central mobile track beam comprises a lateral beam and a first inner side beam and a second inner side beam that are respectively provided on two ends of the lateral beam.

4. The switch for the track of the maglev train according to claim 3, wherein, a roller is provided at a bottom of the lateral beam, so that the middle movable track beam is configured to move between the first outer side beam and the second outer side beam of the central fixed track beam.

5. The switch for the track of the maglev train according to claim 3, further comprising a bearing track provided at the bottom of the lateral beam and configured to cooperate with the roller.

6. The switch for the track of the maglev train according to claim 1, wherein the front main track beam is a cement or steel beam.

7. The switch for the track of the maglev train according to claim 1, wherein the central fixed track beam is a fixed cement or steel beam.

8. The switch for the track of the maglev train according to claim 1, wherein the middle movable track beam is a cement or steel beam.

9. A switch for a track of a maglev train, comprising:

a front main track beam; and a rear switching track beam, wherein, the rear switching track beam comprises a central fixed track beam and a middle movable track beam; wherein, the front main track beam is configured to rotate between a straight track and a bend track, the central fixed track beam is a fixed track beam, and the middle movable track beam is configured to move parallelly between the straight track and the bend track;

if the maglev train passes along the bend track, the front main track beam rotates to the bend track, and the middle movable track beam parallelly moves to the bend track;

if the maglev train passes along the straight track, the front main track beam rotates to the straight track, and the middle movable track beam parallelly moves to the straight track, wherein, the middle movable track beam is a U-shaped track beam.

10. The switch for the track of the maglev train according to claim 9, wherein, the central fixed track beam comprises a first outer side beam for connecting the front main track beam with the bend track and a second outer side beam for connecting the front main track beam with the straight track; wherein, the first outer side beam and the second outer side beam are fixed track beams.

11. The switch for the track of the maglev train according to claim 9, wherein, the central mobile track beam comprises a lateral beam and a first inner side beam and a second inner side beam that are respectively provided on two ends of the lateral beam.

12. The switch for the track of the maglev train according to claim 9, wherein the front main track beam is a cement or steel beam.

13. The switch for the track of the maglev train according to claim 9, wherein the central fixed track beam is a fixed cement or steel beam.

14. The switch for the track of the maglev train according to claim 9, wherein the middle movable track beam is a cement or steel beam.

* * * * *